US006454613B2

(12) United States Patent
Valceschini

(10) Patent No.: US 6,454,613 B2
(45) Date of Patent: Sep. 24, 2002

(54) COAXIAL CONNECTOR

(75) Inventor: Jean-Daniel Valceschini, Renens (CH)

(73) Assignee: Interlemo Holding S.A., Saint-Sulpice (CH)

( * ) Notice: Subject to any disclaimer, the term of this patent is extended or adjusted under 35 U.S.C. 154(b) by 0 days.

(21) Appl. No.: 09/735,754

(22) Filed: Dec. 13, 2000

(30) Foreign Application Priority Data

Dec. 22, 1999 (EP) ..... 99811189

(51) Int. Cl.[7] ..... H01R 13/502
(52) U.S. Cl. ..... 439/701; 439/578
(58) Field of Search ..... 439/578, 579–585, 439/701

(56) References Cited

U.S. PATENT DOCUMENTS

| | | | | |
|---|---|---|---|---|
| 3,404,364 A | | 10/1968 | Paullus | |
| 4,074,927 A | | 2/1978 | Ball | |
| 4,810,209 A | | 3/1989 | Punako | |
| 4,871,328 A | | 10/1989 | Wright | |
| 5,099,572 A | | 3/1992 | Lazaro, Jr. | |
| 5,542,861 A | * | 8/1996 | Anhalt et al. | 439/578 |
| 5,620,339 A | * | 4/1997 | Gay et al. | 439/578 |
| 5,797,761 A | | 8/1998 | Ring | |

FOREIGN PATENT DOCUMENTS

| | | |
|---|---|---|
| DE | 43 08 358 A | 9/1994 |
| EP | 0 292 832 A | 11/1988 |

* cited by examiner

*Primary Examiner*—Gary Paumen
*Assistant Examiner*—James R. Harvey
(74) *Attorney, Agent, or Firm*—Bugnion S.A.; John Moetteli

(57) ABSTRACT

The connector comprises a body (1) provided with a cylindrical bore (14) designed to house an insert (16) of cylindrical shape. The insert (16) is provided with a base (19) and with a first flange (25) which are intended to allow it to be positioned on an insert support (20). A second flange (18) ensures that the insert is positioned angularly in the body (1) with a conjugate female element (17). The insert support (20) is a piece formed from a hollow cylindrical part (21) followed by a cylindrical wall (23) which extends over a peripheral length greater than a peripheral half-length. This wall (23) is divided into two parts by an axial guiding groove (24) with which the first flange (25) mates.

19 Claims, 4 Drawing Sheets

COAXIAL CONNECTOR

BACKGROUND OF THE INVENTION

The present invention relates to a connector, in particular a connector that mates with a conjugate connector in order to link the first and second signal conduction means which terminate in each of the connectors. Such connectors have a body provided with a cylindrical bore designed to house an insert of cylindrical shape. The insert is equipped to receive each of the ends of the first signal conduction device and to connect them to the ends of the second signal conduction device. The insert is also provided with a base and with a first flange which are intended to allow it to be positioned on an insert support.

Such connectors, making it possible to connect, mainly but not exclusively, electrical conductors or optical fibers or even a combination of the two, are well known and have to meet a very high quality of requirements especially with respect to the positioning of the insert. This is because the precise and stable position of the insert is a quality requirement of such connectors since they must allow the interpenetration of the male and female parts of said connectors with corresponding parts of the second connector. Incorrect positioning inside the body of the insert or floating but uncontrolled positioning thereof, that is to say the angular and/or axial movement of the insert cannot be confined within predetermined limits, compromises the quality of the connection, especially when this is a connection comprising optical fibers, and prevents the apparatuses receiving the conducted signals from operating properly.

These connectors are used in several fields, such as civil and military aviation, various electronic appliances, etc, and have different dimensions depending on the use and especially on the power of the conducted signals. In the context of use in civil or military aviation in aircraft, these various elements are subjected to certain stresses, such as vibrations and sudden changes in acceleration, and they must always guarantee a continuous link between the corresponding conduction means.

The connectors used in the above-mentioned applications are mainly of two types. A first type, called push-pull, comprising a male connector and a female connector, which allows coupling between the two connectors by acting on an axially movable outer body of the male connector. The outer body makes it possible to control a locking bushing by which two connectors of conjugate type may be locked together by pushing in one direction and unlocked by pulling on the body. The other type relates to connectors which are coupled by other means, for example simple snap-fastening of one connector in the other or the equivalent. In both cases, the precise angular and axial position of the insert and the absence of uncontrolled floating are required in order to make an easy and reliable connection.

Within the context of an electrical connector, the insert also provides an insulation function and often in this field this insert is called an insulator, even when its function is not necessarily to insulate, for example when the connection concerns only optical fibers.

Usually, the insert has a cylindrical shape and is provided with axial passages in which the rods and/or bushings which are connected on the upstream side to the ends of a cable or of the optical fibers are housed. This insert is provided with a base and a flange which are housed in the insert holder. The insert holder consists of two semi-cylindrical shells which must at least partly match the insert in order to position it with respect to these half-shells. For this purpose, a groove matches the base while the positioning flange is housed in a female element, especially a hole whose dimensions and shape correspond to the flange of the insert. One of the half-shells is also provided with a male element, often having the shape of an axial projection which engages in a corresponding female element, especially a notch, inside the connector body in order to angularly position the insert/insert holder assembly. The insert is thus firstly positioned with respect to the insert holder and then the insert holder ensures that the assembly is centered inside the body of the connector. Complementary elements, such as washers and/or seals, together with a clamping means for example for the cable, and a nut or collet nut ensure axial retention of the insert/insert holder assembly on the upstream side.

This type of insert holder has a number of drawbacks relating to the centering and the mounting of the connector. Firstly, the two half-cylinders are manufactured by screw-machining, for cost reasons since this type of connector should not be expensive, and the manufacturing tolerances mean that the half-shells added around the insert either do not form a complete cylinder, and the shells float in an uncontrolled manner, or they are slightly greater than a half-shell, to the detriment of proper retention of the insert in its support. Thus, upon installation inside the body under the above-mentioned conditions, the insert holder is not positioned precisely and there may be a clearance with respect to the insert holder, that is to say it may float, without this floating being able to be controlled, something which may have unfortunate consequences when linking two connectors together. In addition, particular care must be taken when mounting, in order to choose shells which correspond as best as possible, thereby increasing the labor cost, and this has an impact on the manufacturing cost of the connector as well. Moreover, mounting the insert in its support and then inside the body requires several handling operations and often the insert floats beyond the permissible limits because of the manufacturing tolerances on its support, under the thrust of the cable, place it in a skew position and result, when coupling it to the corresponding connector, in a poor connection or even deform the male and female parts involved.

What is needed therefore is a connector, whether of the push-pull type or not, that has an insert and an insert holder which eliminates the above-mentioned drawbacks.

SUMMARY OF THE INVENTION

The connector according to the invention includes an insert having a second flange which ensures that it is positioned angularly in said body so as to mate with a conjugate female element of the body, the body has a shoulder against which the insert can bear via one of the radial walls of the base which positions it axially in the body and wherein the insert support is a piece formed from a hollow cylindrical part whose outside diameter corresponds to the diameter of the bore of the body followed by a cylindrical wall which extends over a peripheral length greater than a peripheral half-length. The wall is divided into two parts by an axial guiding groove with which the first flange of the insert mates.

The advantages of the connector according to the invention, and more particularly of the insert and the insert support, are significant. The insert is virtually identical to the inserts used up until now, apart from the second flange which allows the insert and the insert support to be angularly positioned inside the body by mating with a female element of the body. Thus, the angular positioning of the insert inside the body depends no longer on the screw-machining manufacture of the insert support but on the manufacturing tolerances on the insert which are much more precise and easy to meet. Retention of the insert by the insert support, and the fitting of it into the support, are very easy since all that is required is to insert the insert into the approximately cylindrical opening formed by the cylindrical wall, taking care to slide the first positioning flange in the groove provided for this purpose. Thus, it is very easy to mount the insert in the insert support and it does not require complicated manipulations. The limiting axial positioning of the insert on the insert support is provided by one of the radial walls of the base of the insert against the edge of the cylindrical wall.

In this case, the centering of the insert inside the body is achieved by the elements which are specific to it, namely the various bearing surfaces—those of the base and those of its downstream part inside the body which has, of course, bores of corresponding diameter, and not by an accumulation of pieces as is the case with the above-mentioned half-shells. The insert is no longer floating in an uncontrolled manner under the thrust of the cable or of the clamping system.

According to one embodiment, the hollow cylindrical part is provided on its outer surface with a guiding flange intended to mate with a conjugate female element located upstream of said body. This flange, with which the hollow cylindrical part of the insert support is provided, located upstream and mating with the female element of the body, ensures the angular positioning of the insert support and at the same time reinforces the correct angular positioning of the insert.

According to one embodiment, the two parts of the cylindrical wall are designed to pinch the insert elastically, that is to say this wall is slightly conical, which is easy to obtain since this cylindrical wall is made in two parts due to the groove. This also makes the manipulations during mounting easier since the insert is properly retained at the end of this cylindrical wall once the corresponding cylindrical part of the insert has been introduced into the cylindrical opening.

According to another embodiment, the insert support is provided on its cylindrical part with a slot into which a seal, for example an O-ring, can be placed, which makes it possible, when necessary, to ensure that the connector on the downstream side is sealed and it is not necessary to provide a seal which has to be protected by a washer against the clamping of the nut or collet nut. In addition, there is no risk of this seal being lost when dismantling the connector.

When the connector is intended to be used for optical fibers, the insert support is provided on its upstream part with a tubular part of smaller diameter, allowing the optical fiber or fibers to be entered and held in place, for example by injecting an adhesive or a similar product.

When the connector is of the push-pull type, the two female elements are located in the inner bushing of this connector, which is in contact with the insert and also the insert support.

Finally, to prevent the insert from possibly being incorrectly positioned with respect to the insert support, the insert is provided with a flange of larger dimensions than those of the groove in the insert holder and placed so that it is not possible to mount the insert on the insert support in an erroneous manner.

BRIEF DESCRIPTION OF THE DRAWINGS

The invention will be described in more detail with the aid of the appended drawing.

DESCRIPTION OF THE PREFERRED EMBODIMENT(S)

Figure 1:
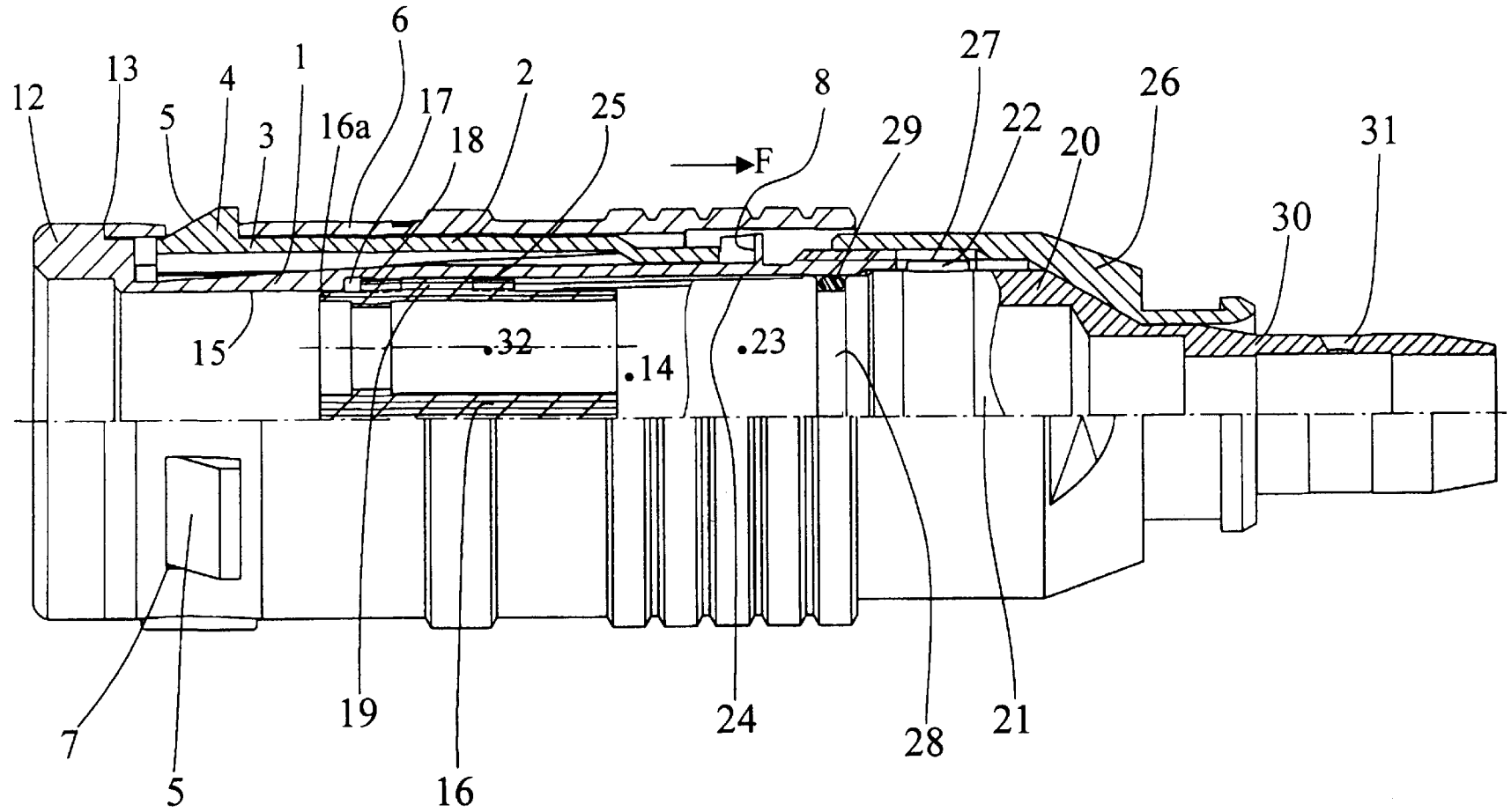
FIG. 1 is a partial sectional view of a male connector of the push-pull type designed to connect optical fibers.

The connector shown in FIG. 1 is composed of an inner bush 1 on which is mounted a locking bushing 2 provided with three resilient projections 3 terminating in catches 4 having a slope 5 toward their downstream ends. The locking bushing 4 is surrounded by an outer body 6 provided with three windows 7 through which the catches 4 pass. The axial fastening in the downstream direction of the connector, both of the locking bushing 2 and the outer body 6, is provided by an attached ring 12 which fits onto the downstream end of the inner bushing 1. The attached ring 12 is fastened by any known means, e.g. screwing, punching, soldering, etc. The ring 12 has a shoulder 13 against which the downstream end of the outer body 6 bears. The locking bush 2 butts against a shoulder 8 of the inner bushing 1. The same shoulder 8 limits the axial movement of the outer body 6 in the direction of the arrow F. The attached ring 12 is fastened to the bushing after the locking bushing 2 and the outer body 6 have been fitted.

This type of push-pull connector is known and for this reason a more detailed description is not necessary.

By moving the outer body 6 in the direction of the arrow F, the catches 4 are pushed radially toward the inside of the connector, and they are therefore moved toward the inner bushing 1, thereby allowing the connector to be disengaged from the conjugate connector. In order to fit the connector, all that is required is to push it into the corresponding conjugate connector and the slope 5 of the catches pushes them inward until the catches 4 have been snap-fastened, that is to say until they are engaged in a corresponding groove of the conjugate connector.

Figure 4:
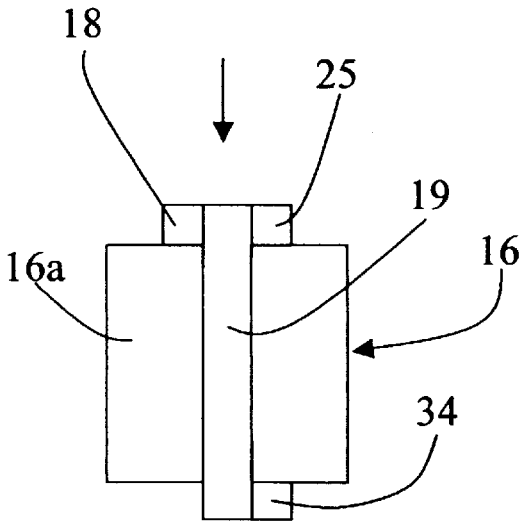
FIGS. 4 and 5 are two views of the insert according to the invention.
Figure 5:
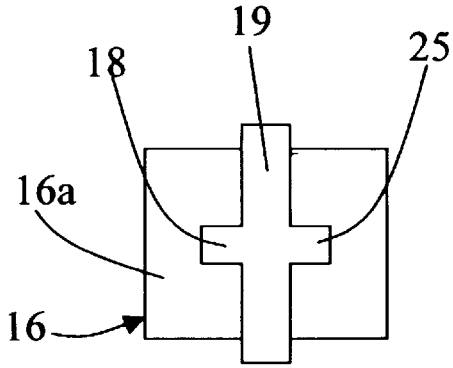

The inner bushing 1 has a bore 14. This bore has, toward the downstream end, a narrowing 15, the diameter of which corresponds to the outside diameter of an insert 16. The shoulder thus formed by the narrowing of the diameter of the bore is provided with a notch 17 in which a flange 18 of an insert 16, which will be described with the aid of FIGS. 4 and 5, is positioned. The insert 16 has a base 19 by which the insert 16 can be positioned against the shoulder created by the difference in the diameters of the bores 14 and 15, thus making it possible to set the limit of the axial position of the insert in the downstream direction of the connector. The flange 18 provides the angular positioning of the insert. Contact between the bearing surface 16*a* downstream of the insert and the bore 15 ensures that the insert is centered without any floating or any uncontrolled floating.

The insert 16 is supported by an insert support 20, the various elements of which will be described with the aid of FIGS. 3 and 4. The insert support 20 comprises a hollow cylindrical part 21 provided with a flange 22 which is housed in a notch 23 of the inner bushing 1, thereby also making it possible to angularly position the insert support and hence the insert. This flange 22 may be omitted, depending on the use and on the dimensions of the connector, but its presence makes it easier for the insert/insert support assembly to be properly positioned. The insert support comprises a cylindrical wall 23 which extends a little more than half of a peripheral length and is located after the cylindrical piece 21. The wall 23 of the insert is separated by a groove 24 into two parts, this groove having a width equal to that of a first flange 25 of the insert 16. The downstream end of the wall 23 abutts against the radial wall of the base 19; thus, when the fastening nut or collet nut 26 is screwed onto a screw thread 27 of the inner bushing 1, the insert is positioned both axially and angularly in a position in which it is stable and cannot float in an uncontrolled manner. The insert holder is provided, when necessary, with a slot 28 in which a seal 29 is housed.

The connector thus described, including the insert and the insert holder according to the invention, ensures that the insert is properly positioned since its positioning inside the bushing 1 is provided by the bearing parts of various surfaces of the insert 16 inside the bore 15 and the shoulder, and its axial positioning, after the nut 26 has been fitted, is also provided and does not depend on the manufacturing tolerances on the insert support, but only on the insert 16.

The connector described relates to a fiber-optic connector and the upstream part of the insert support is provided with a tube 30 having a smaller diameter than that of the cylindrical part 21. This tube 30 is provided with a hole 31 through which an adhesive can be injected in order to fasten the optical fibers inside this tube, since it is not possible to use a clamp, as is the case with an electrical cable.

We will now describe in somewhat more detail the insert support and the insert with the aid of the drawings which follow.

The insert as shown in FIGS. 4 and 5 is a cylindrical piece penetrated by cylindrical passages 32 (see FIG. 1) in which are housed rods and/or bushings allowing interconnection between conduction means terminating in a connector mating with corresponding elements of another connector. The insert 16 is provided with a base 19 and with a first positioning flange 25 allowing it to be positioned in the support. A second flange 18, in principle opposite the first, allows, as mentioned above, the insert to be angularly positioned inside the bushing 1. The radial wall upstream of the base 19 serves as a stop against the ends of the cylindrical wall 23 of the insert support 20 and the flange 25 allows the insert to be positioned angularly with respect to the insert support by being inserted into the groove 24 located in the cylindrical wall 23 of the support. For the purpose of preventing the insert from being incorrectly positioned in the insert support, a flange 34 is provided on its lateral wall. The distance between this flange 34 and the flange 25, as well as its dimensions, prevent the wall 23 from being able to be positioned erroneously with respect to the insert 16.

Figure 2:
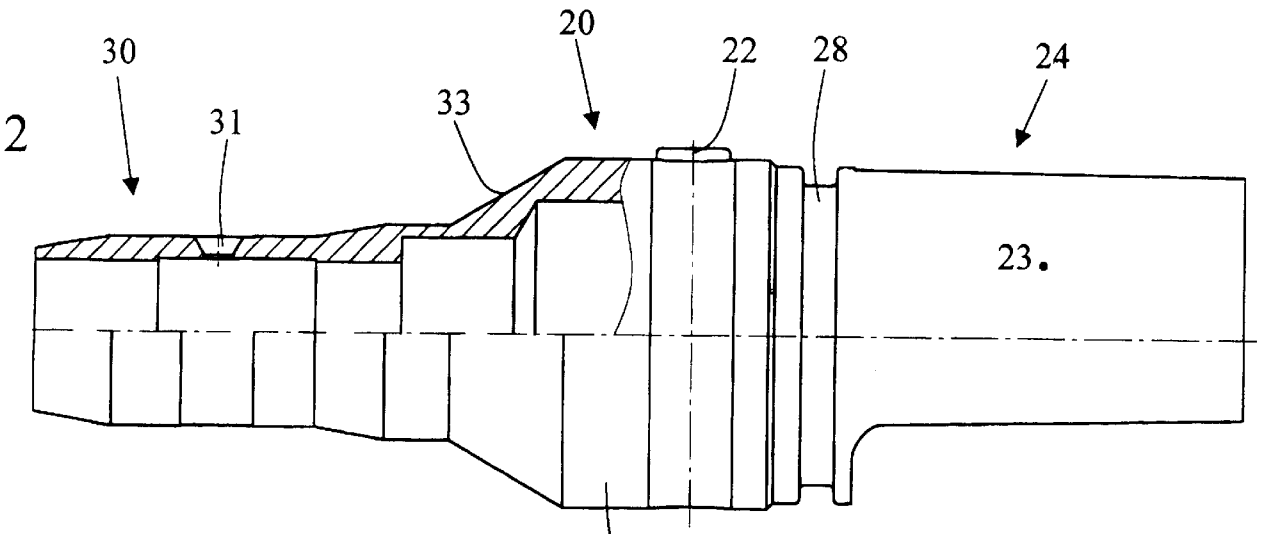
FIGS. 2 and 3 show the insert support from the side and in plan view.
Figure 3:
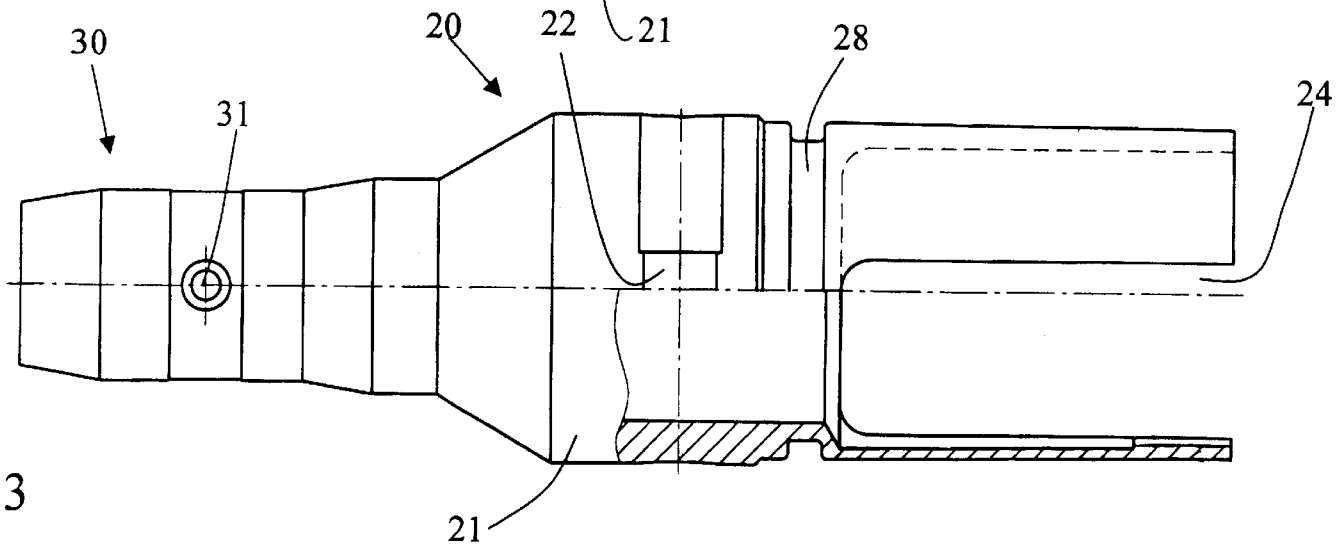

Shown in FIGS. 2 and 3, seen from the side and from above, is an insert support on which can be seen the hollow part 21 followed by a slot 28 for the possible housing of a seal. The cylindrical wall 23 extends slightly more than half of a peripheral length and is separated into two parts by a groove 24. A flange 22 on the hollow part 21 ensures that the insert support is angularly positioned in the inner bushing 1 by mating with the above-mentioned notch 32. In order for the insert to be able to be properly retained when it is at the downstream end of the support, the two parts of the wall 23 are slightly conical toward the downstream part in order to provide a pinching effect on the insert and to hold it in place during manipulations to mount the connector. The insert support 20 also comprises, between the tube 30 and the cylindrical part 21, a frustoconical transition surface 33 making it possible, by mating with a conjugate surface of the nut 26, to ensure correct axial clamping.

Figure 6:
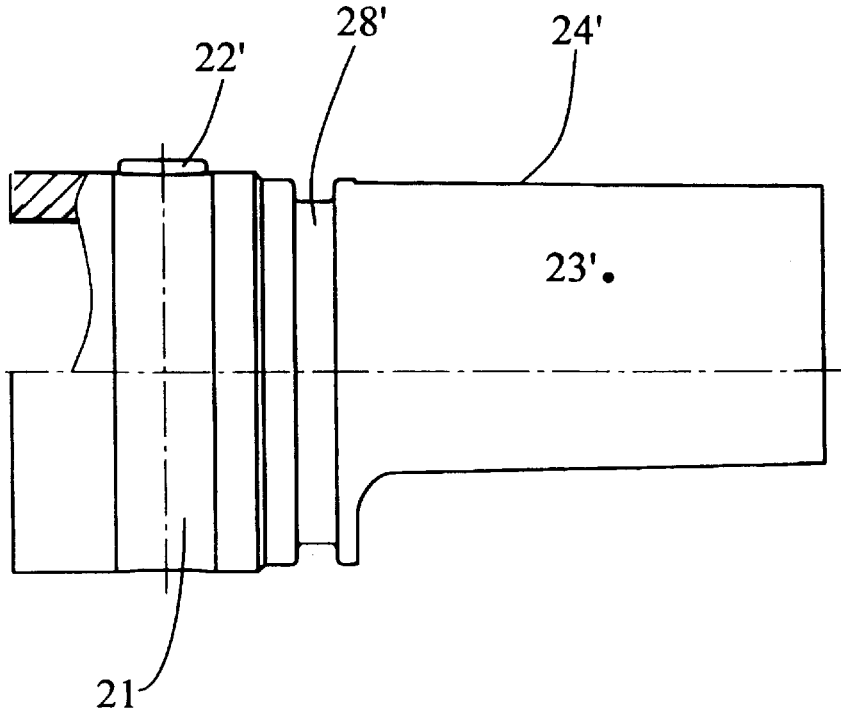
FIG. 6 shows, in side view, an insert support provided for a connector which is not intended for connecting optical fibers.

We have shown in FIG. 6 a piece similar to that in FIG. 2, except that in this case the connector is not provided for optical fibers; thus, the upstream part of the insert support is not necessary. We have used the same reference numbers as for FIG. 2, but with the symbol. In this case, behind the cylindrical part 21', a cable clamp and a corresponding nut or collet nut, which is screwed onto the inner bush 1, are introduced.

Figure 7:
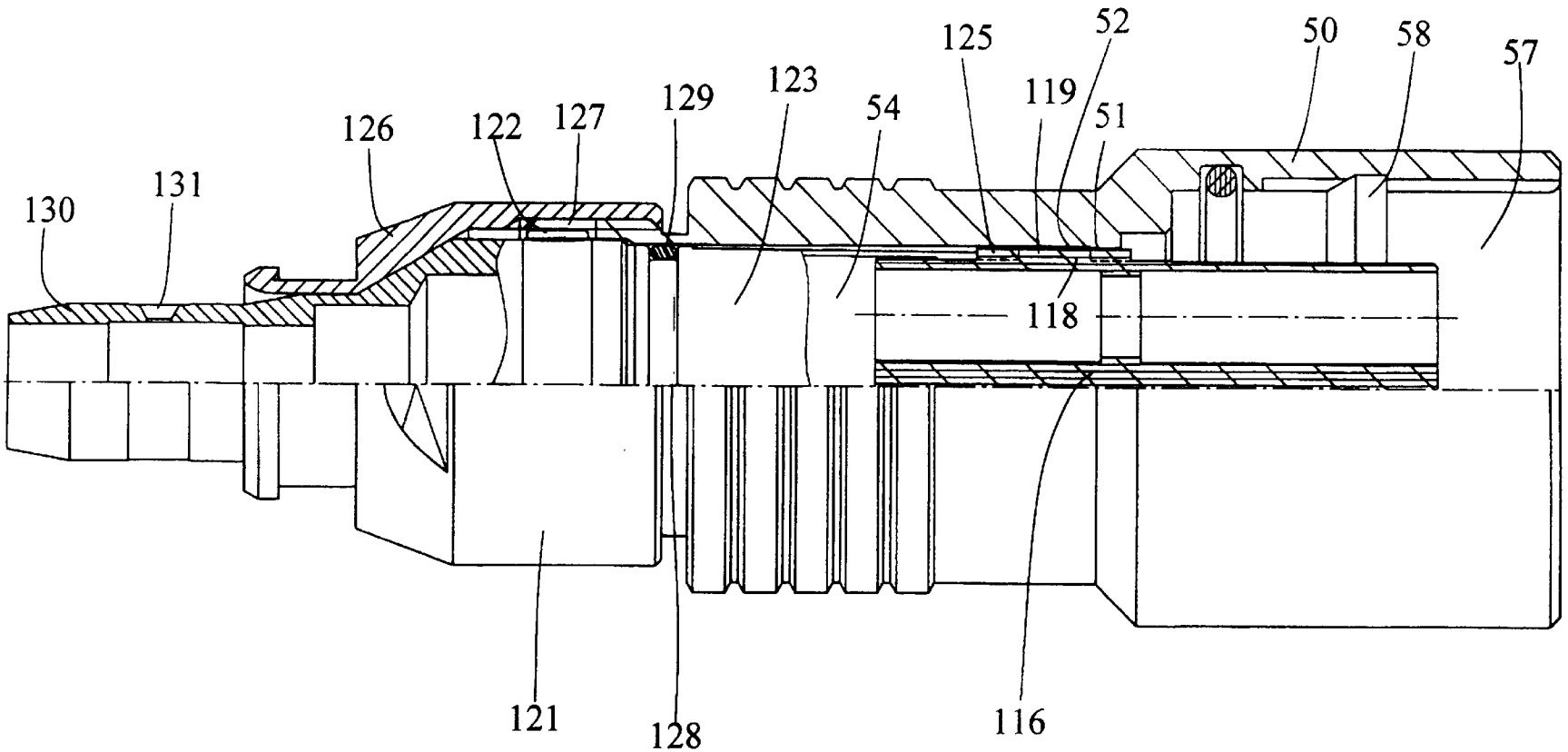
FIG. 7 is a partial sectional view of a female connector of the push-pull type, corresponding to the male connector of FIG. 1.

Shown in FIG. 7 is a female connector intended to mate with the male connector of FIG. 1.

To identify the various parts of this connector, which are the same as those in FIG. 1, we have used the same reference numbers, but preceded by a 1. Thus, the insert support is labeled 120, the insert 116, etc. Of course, the insert does not have exactly the same dimensions, but it is joined to the insert support 120 and to the connector body 50 by the same means. The female connector has a body 50, a shoulder 51 in a bore 54 against which the insert 116 can bear via the radial surface of its base 119. A notch 52 in the body 50 allows the front flange 118 of the insert 116 to be positioned. The downstream part of the connector 50 has a cylindrical part 57 having a diameter sufficient to allow the downstream part of the male connector to be inserted. It also has a recess 58 allowing catches 4 on the male connector to be engaged and hence allowing the assembly to be locked. The insert and the insert support are assembled as in the case of the male connector.

The description has been given in relation to a connector of the push-pull type, but the same construction of the insert and of the insert holder is valid for a normal connector, except that the two female parts (notches) 17 and 23 of the bushing are transferred to the body of the connector in order to allow the insert and the insert support to be angularly positioned. Of course, the inside of the body is provided with a bore having two different diameters in order to allow the insert to be axially positioned by the radial surface of its base.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed:

1. A coaxial connector which mates with a mating connector for linking a first and a second signal conduction means which terminate in each respective connector, said connector comprising at least one body (1; 50) provided with a cylindrical bore (14; 54) housing an insert (16; 116) of cylindrical shape, said insert being equipped to receive each of the ends of the first signal conduction means and to connect them to the ends of the second signal conduction means, said insert (16; 116) provided with a base (19; 119)

and with a first flange (25; 25') which allow the insert to be positioned on an insert support, wherein the insert (16; 116) is provided with a second flange (18; 118) which ensures that the insert is positioned angularly in said body (1; 50) so as to mate with a mating female element (17; 51) of said body (1; 50), wherein said body (1; 50) has a shoulder against which the insert (16; 116) can bear via one of the radial walls of the base (19; 119) and wherein the insert support (20; 20'; 120) is a piece formed from a hollow cylindrical part (21; 21'; 121) whose outside diameter corresponds to the diameter of the bore (14; 54) of said body (1; 50) followed by a cylindrical wall (23; 23'; 123) which extends over a peripheral length greater than a peripheral half-length, said wall (23; 23'; 123) being divided into two parts by an axial guiding groove (24; 24') with which the first flange (25; 25'; 125) of the insert (16; 116) mates.

2. The connector as claimed in claim 1, wherein the insert support (20; 20'; 120) is provided on the upstream end with a hollow cylindrical projection (30; 130) of smaller diameter than that of the hollow cylindrical part (21; 121) intended to receive the signal conduction means.

3. The connector as claimed in claim 1, wherein the hollow cylindrical part (20; 20'; 120) is provided on its outer surface with a guiding flange (22; 22'; 122) intended to mate with a mating female element (27; 27'; 127) located upstream of said body (1; 50).

4. The connector as claimed in claim 3, wherein the insert support (20; 20'; 120) is provided on the upstream end with a hollow cylindrical projection (30; 130) of smaller diameter than that of the hollow cylindrical part (21; 121) intended to receive the signal conduction means.

5. The connector as claimed in claim 1, wherein the two parts of said cylindrical wall (23; 23'; 123) of the insert support are designed to pinch the insert (16; 116) elastically.

6. The connector as claimed in claim 5, wherein the insert support (20; 20'; 120) is provided on the upstream end with a hollow cylindrical projection (30; 130) of smaller diameter than that of the hollow cylindrical part (21; 121) intended to receive the signal conduction means.

7. The connector as claimed in claim 3, wherein the hollow cylindrical part (21; 21'; 121) of the insert support is provided with a slot (28; 28'; 128) for housing a seal (29; 129).

8. The connector as claimed in claim 7, wherein the insert support (20; 20'; 120) is provided on the upstream end with a hollow cylindrical projection (30; 130) of smaller diameter than that of the hollow cylindrical part (21; 121) intended to receive the signal conduction means.

9. The connector as claimed in claim 1, wherein the hollow cylindrical part (21; 21'; 121) of the insert support is provided with a slot (28; 28'; 128) for housing a seal (29; 129).

10. The connector as claimed in claim 9, wherein the insert support (20; 20'; 120) is provided on the upstream end with a hollow cylindrical projection (30; 130) of smaller diameter than that of the hollow cylindrical part (21; 121) intended to receive the signal conduction means.

11. The connector as claimed in claim 3, wherein the two parts of said cylindrical wall (23; 23'; 123) of the insert support are designed to pinch the insert (16; 116) elastically.

12. The connector as claimed in claim 11, wherein the insert support (20; 20'; 120) is provided on the upstream end with a hollow cylindrical projection (30; 130) of smaller diameter than that of the hollow cylindrical part (21; 121) intended to receive the signal conduction means.

13. The connector as claimed in claim 5, wherein the hollow cylindrical part (21; 21'; 121) of the insert support is provided with a slot (28; 28'; 128) for housing a seal (29; 129).

14. The connector as claimed in claim 11, wherein the hollow cylindrical part (21; 21'; 121) of the insert support is provided with a slot (28; 28'; 128) for housing a seal (29; 129).

15. The connector as claimed in claim 13, wherein the insert support (20; 20'; 120) is provided on the upstream end with a hollow cylindrical projection (30; 130) of smaller diameter than that of the hollow cylindrical part (21; 121) intended to receive the signal conduction means.

16. The connector as claimed in claim 14, wherein the insert support (20; 20'; 120) is provided on the upstream end with a hollow cylindrical projection (30; 130) of smaller diameter than that of the hollow cylindrical part (21; 121) intended to receive the signal conduction means.

17. The connector as claimed in one of claims 1 to 16, wherein said connector is of the push-pull type and wherein said female elements (17, 23) of the body are located on the inner bush (1) of said connector.

18. The connector as claimed in one of claims 1 to 16, wherein the insert (16; 116) is provided on its lateral surface with a flange (34), the position and dimensions of which prevent the insert (16) from being incorrectly positioned with respect to the insert support (20; 20').

19. The connector as claimed in claim 17, wherein the insert (16; 116) is provided on its lateral surface with a flange (34), the position and dimensions of which prevent the insert (16) from being incorrectly positioned with respect to the insert support (20; 20').

* * * * *